US010157597B1

(12) United States Patent
Green

(10) Patent No.: US 10,157,597 B1
(45) Date of Patent: Dec. 18, 2018

(54) TREMOLO LOCKING DEVICE

(71) Applicant: Gunnar K. Green, Hackettstown, NJ (US)

(72) Inventor: Gunnar K. Green, Hackettstown, NJ (US)

( * ) Notice: Subject to any disclaimer, the term of this patent is extended or adjusted under 35 U.S.C. 154(b) by 0 days.

(21) Appl. No.: 16/129,069

(22) Filed: Sep. 12, 2018

(51) Int. Cl.
*G10D 3/14* (2006.01)
*G10D 1/08* (2006.01)

(52) U.S. Cl.
CPC ..... *G10D 3/146* (2013.01); *G10D 1/085* (2013.01)

(58) Field of Classification Search
CPC ..... G10D 3/146; G10D 1/085
See application file for complete search history.

(56) References Cited

U.S. PATENT DOCUMENTS 2,741,146 A 8/1954 Fender
3,411,394 A 11/1968 Jones
4,555,970 A 12/1985 Rose
4,697,493 A 10/1987 Ralston
4,763,555 A 8/1988 Minakuchi
4,823,669 A 4/1989 Sarricola, Jr.
4,864,909 A 9/1989 Toney
4,869,145 A 9/1989 Evans
4,882,967 A 11/1989 Rose
4,928,564 A 5/1990 Borisoff
5,088,375 A * 2/1992 Saijo ..... G10D 3/146 84/313
5,127,298 A 7/1992 Snape
5,311,804 A 5/1994 Wilkinson
5,522,297 A 6/1996 Enserink
5,959,224 A 9/1999 McCune
5,986,191 A 11/1999 McCabe
5,986,192 A * 11/1999 Wingfield ..... G10D 3/146 84/313
6,812,389 B2 11/2004 Trooien
6,919,501 B2 7/2005 Burton
6,943,284 B2 9/2005 Didan
7,053,287 B2 5/2006 Dam
7,145,065 B2 12/2006 Geir
7,427,703 B2 9/2008 Geir
7,470,841 B1 12/2008 McCabe
7,531,731 B2 5/2009 Longo
7,557,282 B2 7/2009 Holdway
7,838,752 B2 11/2010 LaMarra
9,029,671 B1 5/2015 Smith
9,330,639 B1 5/2016 Armstrong
9,484,007 B1 11/2016 McCabe
9,502,010 B1 11/2016 Cardozo
9,697,809 B2 7/2017 Cardozo
9,734,804 B1 8/2017 McCabe
(Continued)

*Primary Examiner* — Kimberly Lockett
(74) *Attorney, Agent, or Firm* — Thomas J. Germinario

(57) ABSTRACT

The tremolo locking device is a device applicable to tremolo bridge equipped stringed instruments such as electric guitars. One embodiment of the device provides the means for the instrument player to lock the tremolo at a repeatable position, preventing movement bi-directionally, or to stop the tremolo limiting movement in one direction. It also allows the player to unlock the tremolo bridge completely for its unencumbered full range of use. This is accomplished with a retractable stop assembly providing a repeatable stop location and a screw assembly which holds the tremolo block against the stop.

26 Claims, 5 Drawing Sheets

(56) References Cited

U.S. PATENT DOCUMENTS

| | | | |
|---|---|---|---|
| 9,818,382 | B2 | 11/2017 | Rose |
| 9,837,054 | B1 | 12/2017 | McCabe |
| 9,847,076 | B1 | 12/2017 | McCabe |

* cited by examiner

TREMOLO LOCKING DEVICE

FIELD OF INVENTION

The present invention relates to the general field of stringed musical instruments, and more particularly to stringed instruments utilizing tremolo bridge assemblies.

BACKGROUND OF THE INVENTION

The present invention is applicable to stringed instruments utilizing tremolo bridge assemblies, such as those common to guitars, an example of which is shown in U.S. Pat. No. 2,741,146, to Fender. It is known by those practiced in the art that, although commonly known as tremolo bridges, the effect they create is actually a vibrato effect. Tremolo bridge assemblies are normally located at the end of the strings on the body of the instrument. The strings are typically attached to the bridge assembly and at the other end to tuning pegs which allow for individual string tension adjustment to tune the instrument. Most tremolo bridges pivot, fore-and-aft, at a fulcrum, typically formed by screws, posts, hinge pins or a knife edge. The tension of the strings is counteracted by springs which are attached to an integral part of the tremolo bridge assembly, commonly called the tremolo block. The other ends of the springs are normally attached to the body of the guitar in a manner that allows for adjusting spring tension to accomplish an equilibrium with the tension of the strings when the instrument is in tune. Normally these springs are located inside of the body of the instrument and accessible from the back of the body. This style of tremolo bridge is typically referred to as a "floating" bridge and is most often associated with electric guitars.

A tremolo bridge allows the player to increase or decrease the tension on the strings which changes the pitch the instrument produces, allowing the player to create desired vibrato sound effects. This is normally accomplished by the player manipulating an arm, attached to the bridge, after one or more strings have been strummed. By depressing or raising the arm with enough force to upset the equilibrium between the spring and string tension, the bridge assembly pivots at its fulcrum, which in turn increases or decreases the tension on the attached strings thereby affecting the sound produced.

However, there are problems associated with the common floating tremolo bridge. It is typically time consuming to do the initial setup and tensioning of the tremolo-equipped instrument after new strings are installed, necessitating a procedure of string tensioning and spring adjustment to achieve the required equilibrium. For the inexperienced person, this process can be frustrating. Also, in the event that one of the strings breaks, the remaining strings will go out of tune because the equilibrium is disrupted, rendering the instrument unplayable until the string is replaced and equilibrium is restored. Another problem is that the pitch produced can be affected if the player's hand inadvertently contacts the bridge, which is a common hand resting area, and in doing so disturbs the equilibrium. Yet another problem is experienced if the player intentionally "bends" a string to increase the pitch of a single note, because the pitch of other sound-producing strings will be affected by the disruption to the equilibrium caused by the additional force on the "bent" string.

It is also recognized that the sound producing performance of the instrument is affected by the floating tremolo bridge. The duration that the string or strings produce sound once strummed is referred to in the art as sustain. The dampening effect of the spring biased floating bridge assembly reduces the sustain when compared to a rigid bridge equipped instrument.

Some players of tremolo equipped guitars who do not use the tremolo feature frequently, decide to make the bridge rigid. They eliminate the tremolo feature by locking it down in ways which are not quickly reversible. This is often accomplished by tightening the fulcrum screws along with maximizing the spring tension and adding pieces of wood internally to block the movement of the tremolo block. This does not alter the appearance of the instrument, and by eliminating the tremolo capability, it eliminates the associated problems. However, if the player wishes to restore the tremolo feature, a time-consuming setup procedure will be required to bring it back to function.

Other devices have been proposed to either solve or minimize some of the problems associated with the floating tremolo bridge, but none have addressed all of those listed above. Designs such as Smith U.S. Pat. No. 9,029,671, Cardozo U.S. Pat. No. 9,502,010, Cardoza U.S. Pat. No. 9,697,809, and Wingfield U.S. Pat. No. 5,986,192, provide the ability to lock the tremolo bridge preventing motion in both directions, or unlock the bridge allowing full floating use. However, if applied to existing tremolo equipped instruments, they require the complete replacement or significant modification of the bridge assembly and guitar body, as well as altering the exterior appearance of the instrument.

The lock devices of U.S. Pat. Nos. 7,145,065 and 7,427,703 to Geier, are applicable to existing tremolo equipped instruments. The designs allow the user to lock the tremolo assembly from movement in both directions or to unlock, allowing full motion in both directions. However, if a string breaks while unlocked and in floating operation, the remaining strings go out of tune requiring the replacement of the string and a time-consuming setup procedure before playing can be resumed.

Prior art examples such as McCabe U.S. Pat. No. 9,847,076, McCabe U.S. Pat. No. 9,484,007, Evans U.S. Pat. No. 4,869,145 and Sarricola U.S. Pat. No. 4,823,669, restrict or limit tremolo motion in one direction only. They do not lock the tremolo bi-directionally.

Therefore, there exists a need for a tremolo locking device that will address the above described problems.

SUMMARY OF THE INVENTION

The present invention is a device that can be adapted to function with existing tremolo bridges and existing instruments or incorporated into new articles. This device allows the instrument player to alternate a tremolo bridge assembly from full floating to stopped in one direction or to locked in both directions of movement with minimal effort. This is accomplished with a retractable stop which can be placed in a minimum of unlocked or locked positions allowing full floating or stopped in one direction operation of the bridge assembly. A thumb wheel assembly can be manipulated to secure the tremolo block against the retractable stop preventing motion in both directions.

Accordingly, several advantages are associated with the present invention. The device provides the option of a repeatable position at which the tremolo assembly can be locked, thus reducing setup time during string changes or in the event of a string breaking. It also prevents inadvertent movement of the bridge assembly resulting from hand resting or string bending that would affect pitch. In addition, it creates a rigid interconnection between the bridge assembly and the instrument body, improving tonal sustain. The device can be manipulated to provide the foregoing advantages with minimal effort by the instrument player and requires only minor modification to the host instrument. Other advantages and features of one or more aspects will be apparent from a consideration of the drawings and following detailed description.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
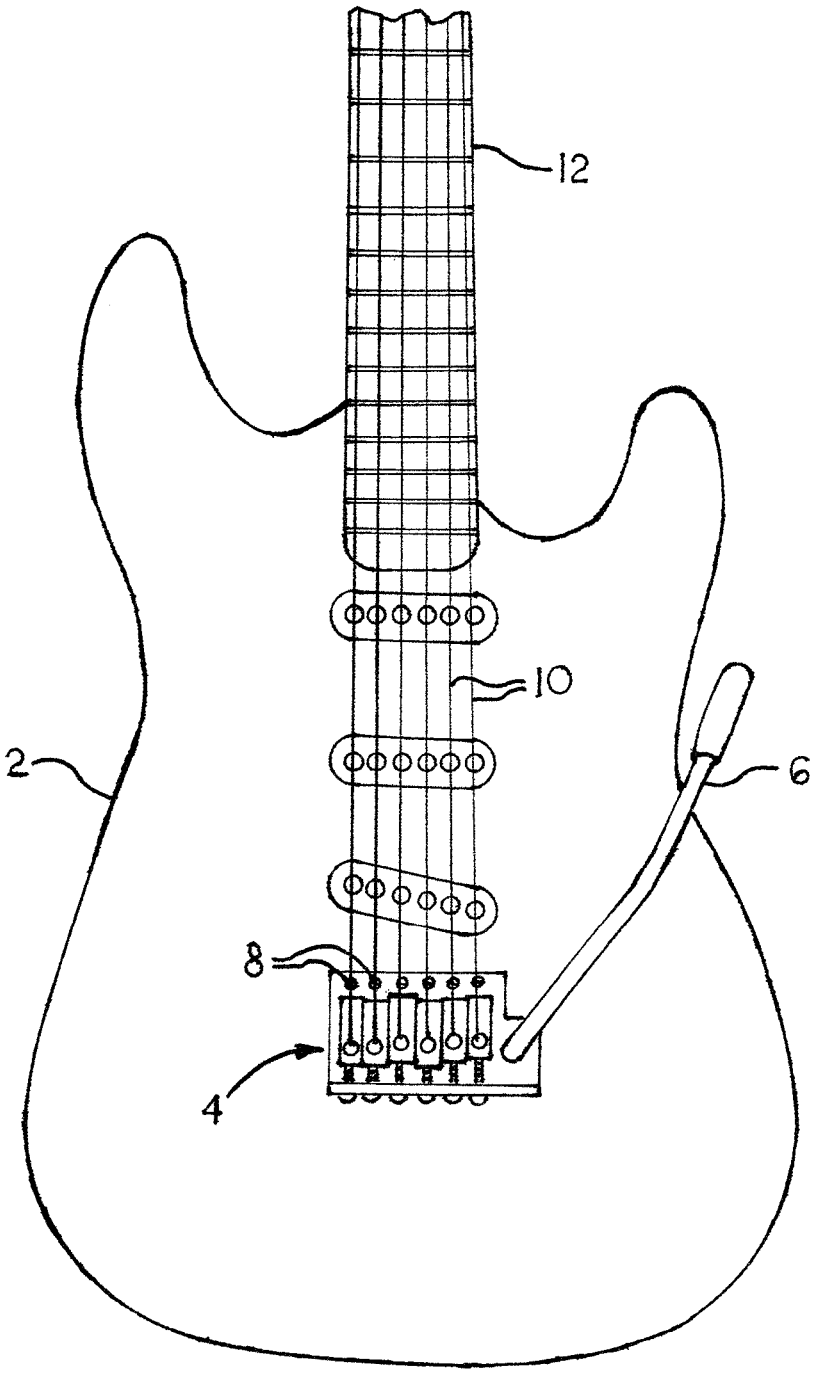
FIG. 1 is a partial front view of an electric guitar with a tremolo bridge assembly.

One embodiment of the present invention is described here for purposes of illustration and not purposes of limitation as it applies to the modern tremolo bridge equipped electric guitar, such as shown in FIG. 1. The device can be modified and scaled up or down to be used with any stringed instrument employing a means to produce vibrato effect. In this embodiment the parts are made of metal and/or plastic.

Figure 2:
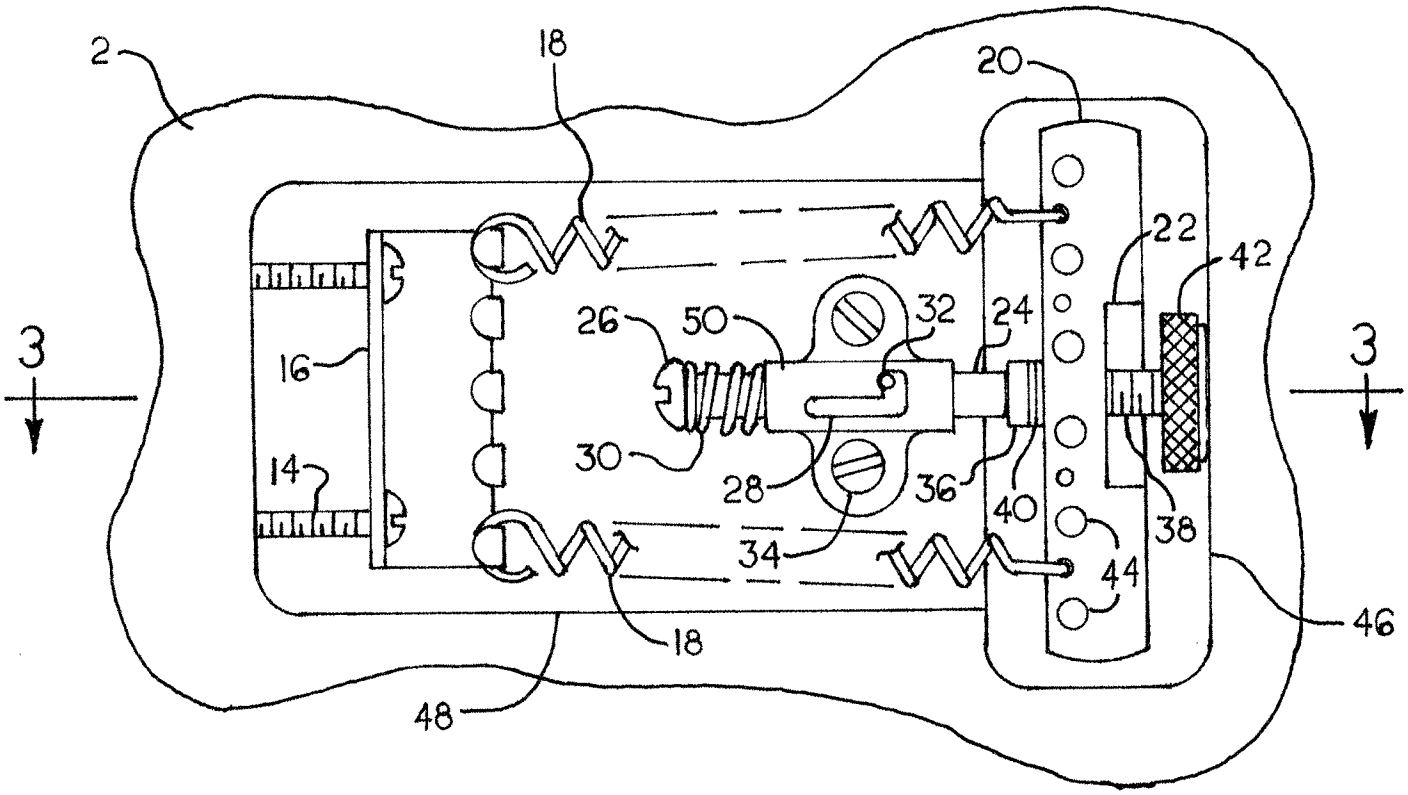
FIG. 2 is a partial rear view of the tremolo cavity in the body of a guitar, schematically showing one embodiment of the locking device in the locked position and associated tremolo assembly components.
Figure 3:
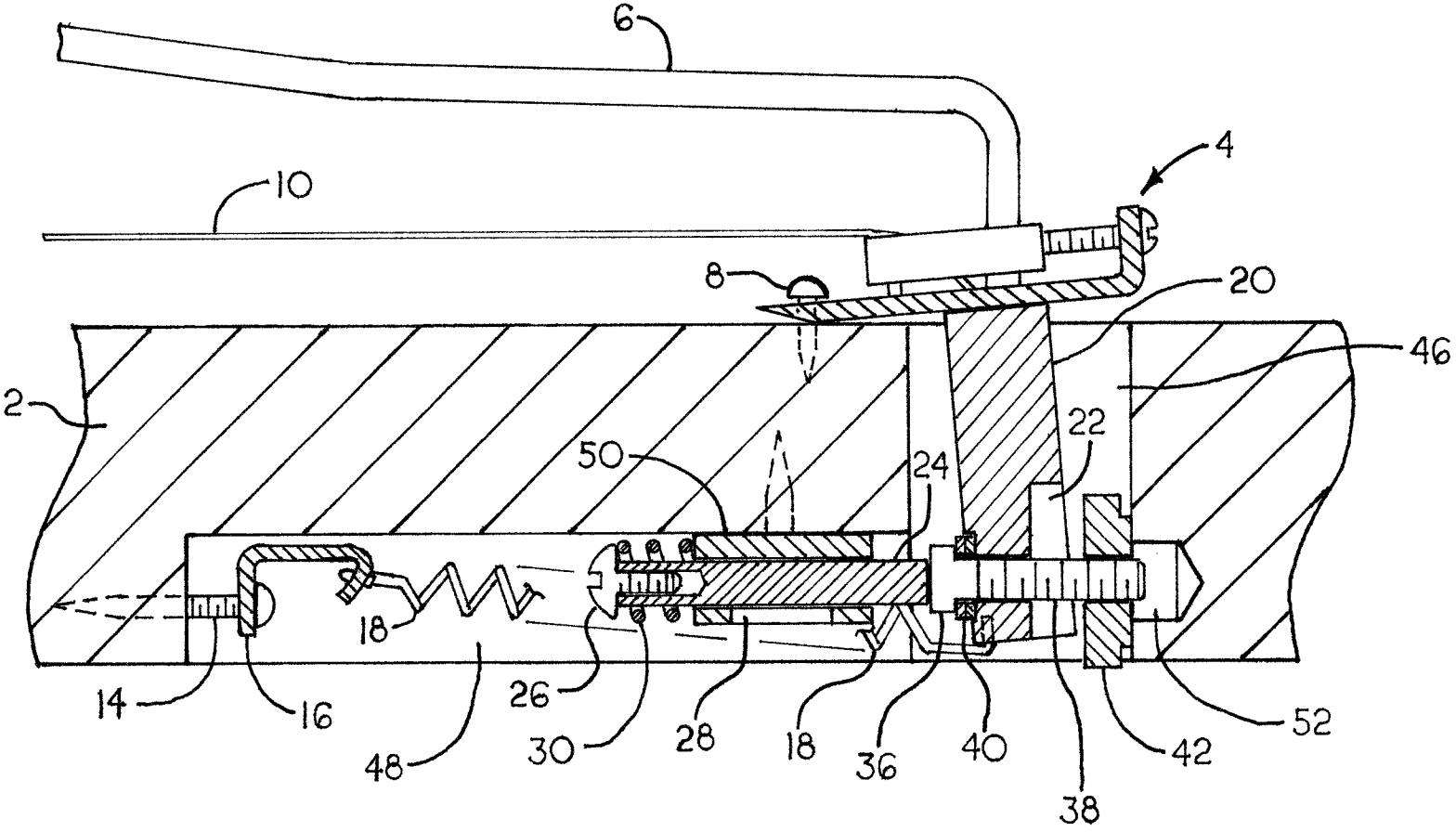
FIG. 3 is a sectional view, along the line 3-3 in FIG. 2, showing the tremolo bridge assembly and one embodiment of the locking device in locked position.

The device of this embodiment is illustrated FIG. 2 and FIG. 3 as it relates to a tremolo bridge assembly 4 of FIG. 1 and FIG. 3. The common relationship, known by those practiced in the art, exists between the bridge assembly 4 and a securely attached tremolo block 20, as seen FIG. 3, and multiple tremolo springs 18, each of which extends between the tremolo block 20 and a spring claw 16 secured to a guitar body 2 by a claw screw 14. Also, in a common manner, the tremolo springs 18 provide a biasing force against strings 10 that are attached to the tremolo bridge assembly 4. The tremolo springs 18 can be adjusted to create a state of equilibrium between themselves and the strings 10 while the tremolo bridge assembly 4 pivots at a fulcrum created at the fulcrum screw 8.

The first embodiment locking device, seen in FIG. 2 and FIG. 3, has a retractable stop comprising a stop housing 50 that is secured with mounting screws 34 in a spring cavity 48 of a guitar body 2 adjacent to the tremolo block 20. Within the stop housing 50 slides a retractable stop bolt 24 that has a pin 32 affixed to it. The pin 32 travels freely within the limits of a bayonet slot 28 of the stop housing 50. The pin 32 extends outside of the stop housing 50 to allow manipulation. A preloaded spring 30 is at the end of the retracting stop bolt 24 and secured between a retaining screw 26 and the stop housing 50.

A block screw 38 passes through and is secured to the tremolo block 20, optionally with one or more spacer washers 40 inserted between the block screw head 36 and the tremolo block 20 for adjustment purposes. A threaded knurled thumb nut 42 travels on the block screw 38 between the tremolo block 20 and the adjacent wall of a tremolo block cavity 46. A clearance pocket 22 in the tremolo block 20 provides adequate clearance for the thumb nut 42. A clearance hole 52 provides clearance for the block screw 38.

The user of the above described embodiment has multiple options as to how they use the tremolo locking device. Some of these options will be described in the following.

The device is shown in FIG. 2 and FIG. 3 in the fully locked position, which prevents movement of the tremolo block 20 and associated tremolo bridge assembly 4 in both directions, effectively creating the characteristics of a non-tremolo equipped instrument. Note also that the illustrations of the above described embodiment include spacer washers 40 between the block screw head 36 and the tremolo block 20. These provide a means to adjust the point of contact of block screw head 36 and retracting stop bolt 24, for reasons including maintaining the angle of the tremolo bridge assembly 4 as it relates to the adjacent surface of guitar body 2 when the retracting stop bolt 24 is extended as shown. This angle and position of the tremolo bridge assembly 4 will be the same when tremolo locking device is unlocked and the tremolo bridge is "floating," the angle being maintained by the equilibrium of forces between the strings 10 and the springs 18.

If the user wants to set the tremolo from fully locked to "dive only," which means the tremolo bridge assembly 4 (FIG. 3) will only move in the direction decreasing string tension when the tremolo arm 6 is depressed, the user needs only to rotate the thumb nut 42 until it is positioned in the clearance pocket 22 of tremolo block 20. This will only allow movement of the tremolo block 20 and connected block screw 38 towards the clearance hole 52. Movement in the opposite direction remains stopped by the retracting stop bolt 24 when pin 32 is positioned within the bayonet slot 28 as shown in FIG. 2.

If the user wants to further unlock the tremolo from "dive only" to "full free floating", only the following needs to be performed. The user needs to move the protruding pin 32 from the position as shown in FIG. 2, by rotating towards the elongated portion of the bayonet slot 28, allowing the attached retracting stop bolt 24 to be drawn away from block screw head 36 by the spring 30 until the pin 32 reaches the limits of bayonet slot 28. This allows the tremolo block 20 to move unobstructed in both directions, allowing full use of tremolo effects by the user.

Reversing the above steps will return the instrument to the desired limits of movement.

Some additions and alternatives to the above described embodiment are described in the following using FIG. 4, FIG. 5, FIG. 6 and FIG. 7 along with nomenclature used on the previously described figures for reference.

Figure 4:
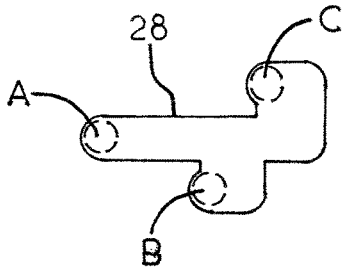
FIG. 4 is a detail plan view showing an alternative embodiment of the bayonet slot, including one of the possible configurations for multiple positions.

The bayonet slot 28 of the previously described stop housing 50 can be shaped to allow for multiple stop positions. FIG. 4 is an example of one such shape that allows pin 32 to be placed at positions A, B or C, which in turn changes the hard stop reference point created by the retracting stop bolt 24. One of the uses of the multiple stop positions is with the use of the following described version of the retracting stop bolt 24 (FIG. 6) when it replaces the retracting stop bolt 24 of the previously described embodiment shown in FIG. 2 and FIG. 3.

Figure 6:
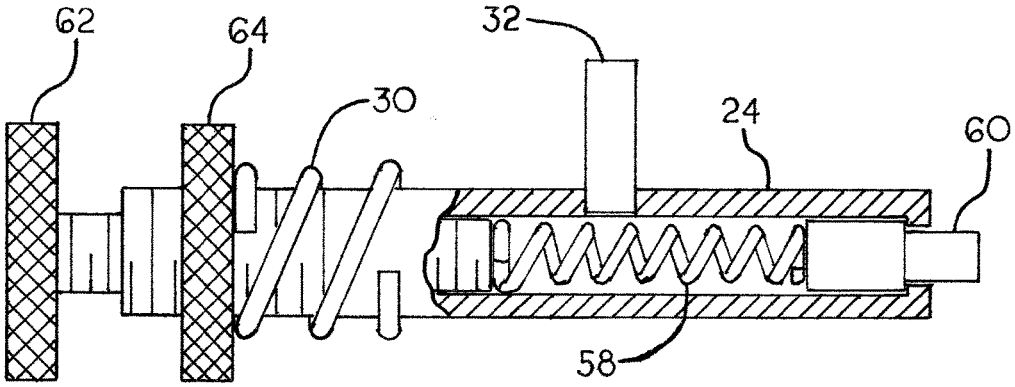
FIG. 6 is a partially sectioned side view of an alternative embodiment of the retracting stop bolt assembly, which includes soft stop and stabilizing features with spring tension adjustability.

The version of the retracting stop bolt 24 illustrated in FIG. 6 includes additional components that create the ability to be used as a "soft stop" in addition to the ability of being used as a "hard stop," such as that described in the first embodiment. The retracting stop bolt 24, shown in FIG. 6, includes a soft stop spring 58 captured between a plunger 60 and a threaded spring thumb screw 62 for adjustment. The stop bolt 24 is also partially threaded on the exterior to mate with the threaded spring thumb nut 64 that creates the ability to adjust the compression of spring 30. In operation, when the pin 32 is placed in a forward position such as position B of the bayonet slot 28 (FIG. 4), the plunger 60 contacts the associated contact point affixed to the tremolo block 20. The spring 58 can be adjusted to the desired amount of force required to be overcome in order to move plunger 60, creating a soft stop. Alternatively, the pin 32 can be placed in a forward position such as position C of the bayonet slot 28 (FIG. 4), and the spring thumb screw 62 adjusted to allow the plunger 60 to retract into the retracting stop bolt 24, allowing the face of the retracting stop bolt 24 to contacts the associated contact point affixed to the tremolo block 20, effectively creating a hard stop.

Additionally, the above described retracting stop bolt 24 (FIG. 6) can include the following feature, allowing its use for an additional purpose. The retracting stop bolt 24 and/or plunger 60 can be magnetically coupled to the contact point on the tremolo block 20. Doing so along with positioning pin 32 in a position within bayonet slot 28 to allow sufficient travel and adjusting the spring 30 at spring thumb nut 64 and soft stop spring 58 at spring thumb screw 62 appropriately, will effectively create, what is known to those practiced in the art, a tremolo stabilizer.

Figure 7:
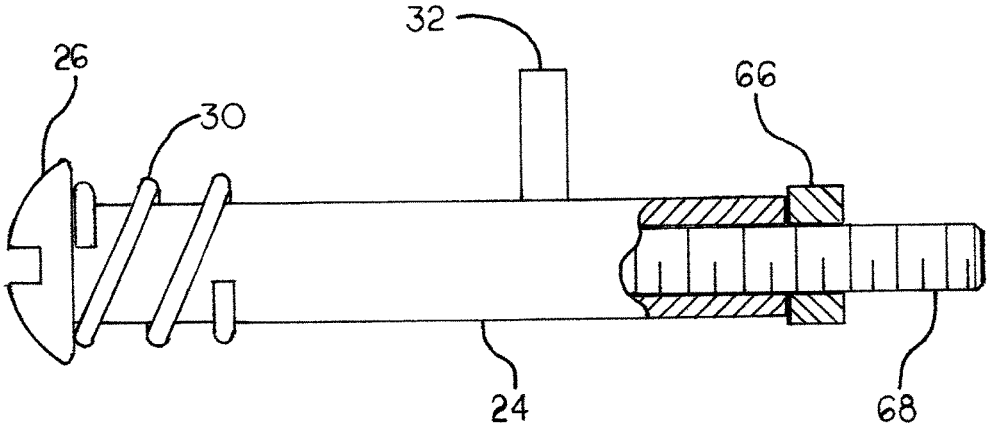
FIG. 7 is a partially sectioned side view of an alternative embodiment of the retracting stop bolt assembly, which includes a threaded extension and lock nut.

Another alternative version of the retracting stop bolt 24 is illustrated in FIG. 7. This version includes a threaded extension 68 which mates with the retracting stop bolt 24 and provides adjustment of the hard stop location by adjusting the amount the threaded extension 68 protrudes from the retracting stop bolt 24 and securing its position with a lock nut 66. Alternatively, the retracting stop bolt 24 can be made to allow the threaded extension 68 to pass through its entire length and the lock nut 66 positioned where the retaining screw 26, (FIG. 7) is shown.

Figure 5:
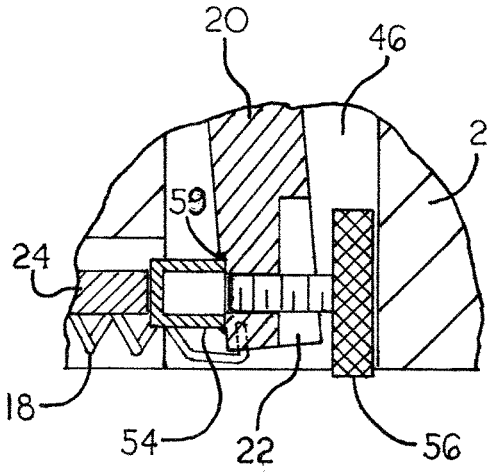
FIG. 5 is a partial sectional view of the tremolo block area of FIG. 3, with an alternative embodiment of the thumb screw assembly.

An alternative to the block screw 38, thumb nut 42 and tremolo block 20 arrangement described in the first embodiment (FIG. 2 and FIG. 3) is illustrated FIG. 5. In this embodiment the need for clearance hole 52, (FIG. 3), is eliminated by using a thumb screw 56 (FIG. 5) that mates with a threaded hole in the tremolo block 20. A stop contacting surface and clearance for the protruding screw is created with stop cap 54 that is affixed to the tremolo block 20 at weld 59.

From the description above, a number of advantages of some embodiments of the tremolo locking device become evident.

(a) It allows the user to alternate between multiple bridge configurations with associated advantages and with minimal effort without the need for multiple instruments.

(b) It provides a repeatable reference point at which the tremolo bridge can be placed during initial setup or in the event a string breaks requiring replacement. This both simplifies and reduces the effort required to perform these tasks.

(c) In the event a string breaks while the tremolo bridge is in full floating configuration, the bridge can be returned to the original setup position and locked, regaining the playability and in tune tone of the remaining strings. This can be accomplished quickly and with minimal effort.

(d) When locked, "string bending" will not affect the pitch produced by other strings, nor will a hand resting on the bridge affect the pitch produced by the strings.

(e) It can be configured to act as a tremolo stabilizer.

(f) When locked, it improves tonal sustain.

(g) It does not significantly affect the appearance of the instrument.

(h) It can be adapted for use in existing tremolo equipped instruments with minimal modification to the instrument.

Accordingly, the tremolo locking device of various embodiments solves multiple problems associated with tremolo equipped instruments, while providing the instrument player the ability to regain the original tremolo characteristics quickly and with minimal effort. Furthermore, the tremolo locking device has additional advantages in that:

- its components can be produced in various shapes and dimensions to better fit the host instrument and/or tremolo bridge assembly;
- its advantages can be realized in numerous types of stringed instruments;
- it can be made from numerous types of materials and with numerous types of finishes for reasons such as, but not limited to, adapting to methods of manufacturing, altering physical properties and aesthetics;

It is recognized that an advantage of the retracting stop bolt design is its ability to be made in many shapes and adapted to various methods of latching such as the use of a pivoting finger latch which engages a recess, or a sliding cross bolt type of latch engaging a recess. This versatility makes the retracting stop bolt design adaptable to various methods of manufacturing.

While the description contains many specificities, these should not be construed as limitations on the scope of the embodiments, but merely providing examples of some of several embodiments. Many other variations are possible. Thus, the scope of the embodiments should be determined by the appended claims and their legal equivalents, rather than by the examples given.

Although the preferred embodiments of the present invention have been disclosed for illustrative purposes, those skilled in the art will appreciate that many additions, modifications and substitutions are possible, without departing from the scope and spirit of the present invention as defined by the accompanying claims.

What is claimed is:

1. A releasable tremolo locking device for a musical instrument, which has an instrument body containing a tremolo block cavity, and which has multiple strings, and which has a movable tremolo bridge, whereby tension on the strings is adjusted by movement of the tremolo bridge, the device comprising:

- a movable tremolo block, which has a proximal side and a distal side, and which has a clearance pocket on the distal side, and which is connected to the tremolo bridge, and which extends into the tremolo block cavity;

a retractable stop, comprising a stop housing secured to the instrument body adjacent to the tremolo block, wherein the stop housing has a proximal end and a distal end, and wherein the stop housing slidably engages a retractable stop bolt, having a proximal end and a distal end, and wherein the stop bolt travels between two or more repeatable bolt positions, and wherein the proximal end of the stop bolt, or a stop plunger or a threaded stop extension extending from the proximal end of the stop bolt, engages, at a repeatable stop position, a tremolo block contact extending from the proximal side of the tremolo block, and wherein bolt positions comprise a fully extended bolt position, in which the stop bolt maximally extends toward the tremolo block, and one or more retracted bolt positions, including a fully retracted bolt position, in which the stop bolt maximally retracts away from the tremolo block; and a block screw, having a proximal end and a distal end, wherein the proximal end of the block screw forms or engages the tremolo block contact.

2. The releasable tremolo locking device according to claim 1, wherein the stop housing further comprises a longitudinally axial housing bore, which slidably engages the stop bolt, and a bayonet slot, and wherein the stop bolt further comprises a protruding bolt pin that extends through the bayonet slot of the stop housing and travels between two or more repeatable bolt pin positions which correspond to the two or more repeatable bolt positions, and wherein a stop spring extends between a stop spring retainer on the stop bolt and the distal end of the stop housing, and wherein the bolt pin positions comprise a fully extended pin position, in which the stop spring is fully compressed to allow a full extension of the stop bolt toward the tremolo block, and one or more retracted pin positions, including a fully retracted pin position, in which the stop spring fully expands to pull the stop bolt away from the tremolo block, and wherein the distal end of the block screw has a block screw restrainer, which comprises either a travelling thumb nut or a fixed thumb screw head.

3. The releasable tremolo locking device according to claim 1, wherein the device can be placed in a fully locked configuration, in which the stop bolt is in the fully extended bolt position and the distal end of the block screw engages an adjacent wall of the tremolo block cavity, thereby preventing movement of the tremolo block and the tremolo bridge.

4. The releasable tremolo locking device according to claim 3, wherein the device can be placed in a dive-only configuration, in which the stop bolt is in the fully extended bolt position and the distal end of the block screw is fully within the clearance pocket of the tremolo block, thereby allowing the tremolo block and the tremolo bridge to rotate only in the counter-clockwise direction.

5. The releasable tremolo locking device according to claim 4, wherein the device can be placed in a free-floating configuration, in which the stop bolt is in the fully retracted bolt position and the distal end of the block screw is fully within the clearance pocket of the tremolo block, thereby allowing the tremolo block and the tremolo bridge to rotate in both clockwise and counter-clockwise directions.

6. The releasable tremolo locking device according to claim 2, wherein the device can be placed in a fully locked configuration, in which the bolt pin is in the fully extended pin position and the block screw restrainer engages an adjacent wall of the tremolo block cavity, thereby preventing movement of the tremolo block and the tremolo bridge.

7. The releasable tremolo locking device according to claim 6, wherein the device can be placed in a dive-only configuration, in which the bolt pin is in the fully extended pin position and the block screw restrainer is fully within the clearance pocket of the tremolo block, thereby allowing the tremolo block and the tremolo bridge to pivot only in a counter-clockwise direction.

8. The releasable tremolo locking device according to claim 7, wherein the device can be placed in a free-floating configuration, in which the bolt pin is in the fully retracted pin position and the block screw restrainer is fully within the clearance pocket of the tremolo block, thereby allowing the tremolo block and the tremolo bridge to rotate in both clockwise and counterclockwise directions.

9. The releasable tremolo locking device according to claim 8, wherein the block screw passes through the tremolo block, and wherein a block screw head at the proximal end of the block screw forms the tremolo block contact, and wherein the block screw restrainer comprises the travelling thumb nut, and wherein the stop spring retainer comprises a retainer screw threaded into the distal end of the stop bolt, and wherein the proximal end of the stop bolt engages the tremolo block contact, and wherein there are two bolt pin positions, consisting of the fully extended pin position and the fully retracted pin position.

10. The releasable tremolo locking device according to claim 9, further comprising a clearance hole in the adjacent wall of the tremolo block cavity, wherein the clearance hole receives the distal end of the block screw when the device is in the dive-only configuration or in the free-floating configuration.

11. The releasable tremolo locking device according to claim 10, further comprising one or more spacer washers inserted between block screw head and the tremolo block, whereby a position of the tremolo block contact can be adjusted.

12. The releasable tremolo locking device according to claim 8, further comprising a stop cap that extends from the proximal side of the tremolo block and forms the tremolo block contact, wherein the stop cap has an interior cavity which is configured to receive the proximal end of the block screw, and wherein the block screw restrainer comprises the fixed thumb screw head, and wherein the proximal end of the stop bolt engages the tremolo block contact, and wherein there are two bolt pin positions, consisting of the fully extended pin position and the fully retracted pin position.

13. The releasable tremolo locking device according to claim 8, wherein the stop bolt has a longitudinally axial bolt bore, containing a plunger spring, which has a proximal end and a distal end, and wherein the plunger spring biases a stop plunger toward the proximal end of the stop bolt, and wherein the distal end of the plunger spring engages and is adjustably restrained by a plunger spring thumb screw threaded into the distal end of the stop bolt, and wherein the distal end of the stop bolt has exterior threading which mates with a threaded retainer thumb nut that forms the stop spring retainer, and wherein the stop plunger has a proximal end which engages the tremolo block contact, and wherein there are three bolt pin positions, consisting of the fully extended pin position, the fully retracted pin position and a partly retracted pin position between the fully extended pin position and the fully retracted pin position.

14. The releasable tremolo locking device according to claim 13, wherein a block screw head at the proximal end of the block screw forms the tremolo block contact, and wherein the block screw restrainer comprises the travelling nut.

15. The releasable tremolo locking device according to claim 14, further comprising a clearance hole in the adjacent wall of the tremolo block cavity, wherein the clearance hole receives the distal end of the block screw when the device is in the dive-only configuration or in the free-floating configuration.

16. The releasable tremolo locking device according to claim 15, further comprising one or more spacer washers inserted between block screw head and the tremolo block, whereby a position of the tremolo block contact can be adjusted.

17. The releasable tremolo locking device according to claim 13, further comprising a stop cap that extends from the proximal side of the tremolo block and forms the tremolo block contact, wherein the stop cap has an interior cavity which is configured to receive the proximal end of the block screw, and wherein the block screw restrainer comprises the fixed thumb screw head, and wherein the proximal end of the stop bolt engages the tremolo block contact.

18. The releasable tremolo locking device according to claim 16, wherein the device can be placed in a soft-stop position, in which a plunger spring tension is adjusted by the plunger spring thumb screw to enable movement of the stop plunger, and wherein the bolt pin is in the partly retracted pin position.

19. The releasable tremolo locking device according to claim 17, wherein the device can be placed in a soft-stop configuration, in which a plunger spring tension is adjusted by the plunger spring thumb screw to enable movement of the stop plunger, and wherein the bolt pin is in the partly retracted pin position.

20. The releasable tremolo locking device according to claim 18, wherein the stop bolt or the stop plunger, or both the stop bolt and the stop plunger are magnetically coupled to the tremolo block contact, with the device in the soft-stop configuration, thereby configuring the device to operate as a tremolo stabilizer.

21. The releasable tremolo locking device according to claim 19, wherein the stop bolt or the stop plunger, or both the stop bolt and the stop plunger are magnetically coupled to the tremolo block contact, with the device in the soft-stop configuration, thereby configuring the device to operate as a tremolo stabilizer.

22. The releasable tremolo locking device according to claim 8, wherein the stop bolt has a longitudinally axial threaded bolt bore, containing a conjugately threaded stop extension, which has a proximal end and a distal end, and which is adjustably extendable beyond the proximal end of the stop bolt to adjustably locate a repeatable hard stop position at which the proximal end of the threaded stop extension engages the tremolo block contact.

23. The releasable tremolo locking device according to claim 22, wherein a block screw head at the proximal end of the block screw forms the tremolo block contact, and wherein the block screw restrainer comprises the travelling nut.

24. The releasable tremolo locking device according to claim 23, further comprising a clearance hole in the adjacent wall of the tremolo block cavity, wherein the clearance hole receives the distal end of the block screw when the device is in the dive-only configuration or in the free-floating configuration.

25. The releasable tremolo locking device according to claim 24, further comprising one or more spacer washers inserted between block screw head and the tremolo block, whereby a position of the tremolo block contact can be adjusted.

26. The releasable tremolo locking device according to claim 22, further comprising a stop cap that extends from the proximal side of the tremolo block and forms the tremolo block contact, wherein the stop cap has an interior cavity which is configured to receive the proximal end of the block screw, and wherein the block screw restrainer comprises the fixed thumb screw head.

* * * * *